US008181887B2

(12) United States Patent
Seifert et al.

(10) Patent No.: US 8,181,887 B2
(45) Date of Patent: May 22, 2012

(54) DEVICE FOR POSITIONALLY SECURING AND GUIDING RAILS FOR RAILWAY TRACKS

(75) Inventors: Dietrich Seifert, Thal (DE); Dirk Vorderbrück, Werdohl (DE); Winfried Bösterling, Neuenrade (DE)

(73) Assignee: Vossloh-Werke GmbH, Werdohl (DE)

( * ) Notice: Subject to any disclaimer, the term of this patent is extended or adjusted under 35 U.S.C. 154(b) by 89 days.

(21) Appl. No.: 12/304,067

(22) PCT Filed: Jun. 13, 2007

(86) PCT No.: PCT/EP2007/055811
§ 371 (c)(1),
(2), (4) Date: Feb. 11, 2009

(87) PCT Pub. No.: WO2007/144366
PCT Pub. Date: Dec. 21, 2007

(65) Prior Publication Data

US 2010/0127092 A1 May 27, 2010

(30) Foreign Application Priority Data

Jun. 14, 2006 (DE) ..... 20 2006 009 340 U

(51) Int. Cl.
*E01B 9/00* (2006.01)

(52) U.S. Cl. ..... 238/310; 238/349; 238/351

(58) Field of Classification Search ..... 238/2, 3, 238/5, 7, 8, 9, 310, 336, 338, 349
See application file for complete search history.

(56) References Cited

U.S. PATENT DOCUMENTS

| | | | | |
|---|---|---|---|---|
| 3,519,205 | A * | 7/1970 | Monclin et al. | 238/338 |
| 4,066,212 | A * | 1/1978 | Sonneville | 238/349 |
| 4,907,740 | A * | 3/1990 | Oberweiler et al. | 238/283 |
| 5,096,119 | A * | 3/1992 | Schultheiss et al. | 238/349 |
| 5,125,573 | A * | 6/1992 | Vanotti | 238/351 |
| 6,257,495 | B1 * | 7/2001 | Eisenberg | 238/349 |

(Continued)

FOREIGN PATENT DOCUMENTS

DE 2600416 3/1977

(Continued)

OTHER PUBLICATIONS

International Search Report for International Application No. PCT/EP2007/055811.

*Primary Examiner* — S. Joseph Morano
*Assistant Examiner* — Jason C Smith
(74) *Attorney, Agent, or Firm* — Proskauer Rose LLP

(57) ABSTRACT

A device for positional securing and guiding of rails for railway tracks for trains, in particular high-speed trains, includes guide plates. In general, rails are laid directly or indirectly by intermediate assembly of intermediate plates to fixed concrete track beds and guide plates, against which the rail base and possibly intermediate plates lie laterally. Guide plates are embedded on or in the concrete track beds, wherein the guide plates are fabricated of high-strength, form-stable material, preferably reinforced plastic, such as for example glass-fiber reinforced plastic, in particular polyamide. The device according to the invention allows to create guide plates which are overall more wear resistant. Wear resistance is achieved in that the guide plate within the surface area, on which the rail base rests, has an insert or areas provided with inserts, the insert being fabricated of slippable, low-abrasion or friction-resistant, low-wear or wear-resistant and flexibly resilient material.

8 Claims, 2 Drawing Sheets

U.S. PATENT DOCUMENTS

| | | | | |
|---|---|---|---|---|
| 2004/0232254 | A1* | 11/2004 | Kowalski | 238/264 |
| 2008/0105758 | A1* | 5/2008 | Schwiede et al. | 238/349 |
| 2008/0179419 | A1* | 7/2008 | Vives Clavel | 238/264 |
| 2008/0257972 | A1* | 10/2008 | Vorderbruck et al. | 238/331 |
| 2009/0084864 | A1* | 4/2009 | Bosterling et al. | 238/349 |
| 2010/0127092 | A1* | 5/2010 | Seifert et al. | 238/265 |
| 2010/0200666 | A1* | 8/2010 | Bosterling et al. | 238/310 |

FOREIGN PATENT DOCUMENTS

| | | |
|---|---|---|
| DE | 4219546 | 5/1993 |
| DE | 19516097 | 11/1996 |
| EP | 0962592 | 12/1999 |

* cited by examiner

DEVICE FOR POSITIONALLY SECURING AND GUIDING RAILS FOR RAILWAY TRACKS

CROSS-REFERENCE TO RELATED APPLICATIONS

This application is a National Phase Application of International Application No. PCT/EP2007/055811, filed on Jun. 13, 2007, which claims the benefit of and priority to German patent application no. DE 10 2006 009 340.0, filed Jun. 14, 2006. The disclosure of the above applications are incorporated herein by reference in their entirety.

FIELD OF THE INVENTION

The invention relates to a device for positional securing and guiding of rails for railway tracks for trains, in particular high-speed trains, wherein the rails are laid directly or indirectly by intermediate assembly of intermediate plates to fixed concrete track beds and guide plates, against which the rail base and optional intermediate plates lie laterally, are embedded on or in the concrete track beds, wherein the guide plates are fabricated of high-strength, form-stable material, preferably reinforced plastic, such as for example glass-fiber reinforced plastic, in particular polyamide.

BACKGROUND

Devices with guide plates are known in the prior art. Although the fiber-reinforced polyamide material predominantly used today for such plates has the characteristic of being highly stable and strong, a disadvantage is that such plates have low resistance against abrasion at the point of contact with the rail base. This is evidently due to the fact that the lateral support faces lying against the rail base quickly become worn due to the large amount of load alternations, the passage of each individual axle of a train corresponding to one load alternation.

SUMMARY OF THE INVENTION

On the basis of this prior art, an aspect of the invention is to create guide plates, which are altogether more wear resistant.

In accordance with this aspect, embodiments the invention provide that the guide plate within the search area, on which the rail base rests, has an insert or areas provided with inserts, the insert being fabricated of slippable, low-abrasion or friction-resistant, low-wear or wear-resistant and flexibly resilient material.

The use of such inserts in the areas, on which friction arises between the guide plate and the rail base, leads to the fact that, due to the slippability and sufficient flexibility of the inserts, these inserts or insert segments resiliently absorb the alternating load of the rail. As a result, this leads to less wear of the guide plate overall, so that long service life of such guide plates is achieved.

In an embodiment of the present invention, it is proposed that the inserts are fabricated of polyoxymethylene.

Such inserts can be built mechanically into the guide plate. Preferably, however, it is proposed that the inserts are molded into the guide plate.

In particular, it is proposed that the inserts are formed integrally with the guide plate by way of multi-component injection molding.

In principle, the face of the inserts turned towards the contact surface of the rail should lie freely. In some embodiments, the inserts protrude slightly above the contact surface of the guide plate.

In the case of devices, wherein a spacer made from a first plastic plate, a second plastic plate and a steel plate arranged in the middle of these is provided between rail base and concrete track bed, likewise wear of the guide plate takes place in the area, in which the steel plate lies against the guide plate and affects this. Also, in order to achieve reduction of wear in this area, the invention proposes that, in the area of the edge at least of the steel plate, which lies against the guide plate, the guide plate is provided with an insert or insert segments.

Such inserts can be used in all areas of the guide plate, in which friction arises between metallic components and the guide plate.

DESCRIPTION OF THE DRAWINGS

Exemplary embodiments of the invention are described in detail below and illustrated in the drawing, wherein.

Figure 4:
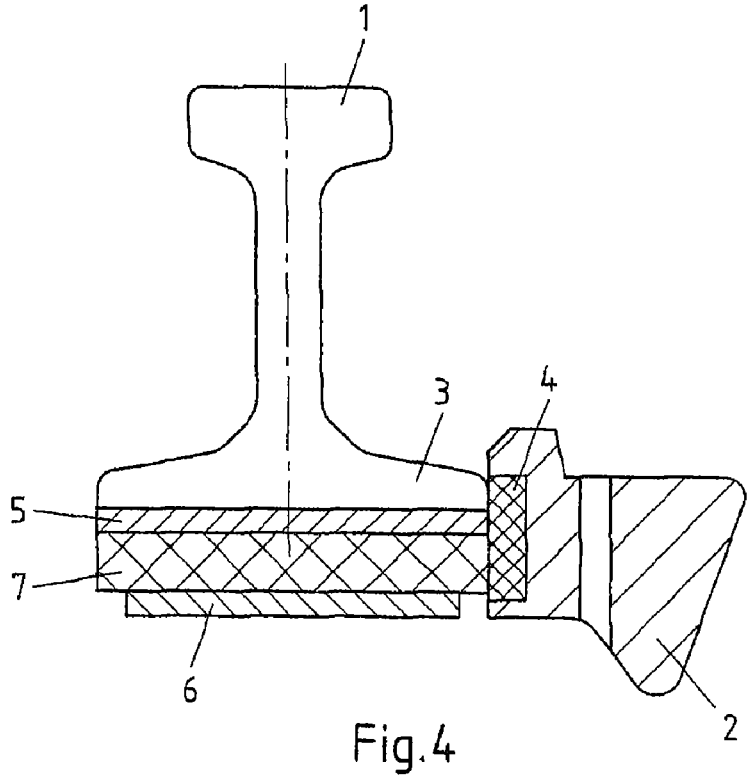
FIG. 4 shows the guide plate and an associated rail along the line IV-IV seen in FIG. 3.

The principle of the invention, in general, is illustrated in the figures. Overall, the invention relates to a device for positional securing and guiding of rails 1. The rails 1 are laid either directly or, as illustrated in FIG. 4, by intermediate assembly of intermediate plates on concrete track beds. Corresponding guide plates 2, against which the rail base 3 and possibly the intermediate plates lie laterally, are embedded on or in these concrete track beds. Such guide plates 2 are fabricated of high-strength, form-stable material, for example glass-fiber reinforced polyamide.

In the surface areas, within which the guide plate 2 lies laterally against the rail base 3, the guide plate 2 is provided with an insert 4 or with several inserts 4 formed as a segment. These inserts are fabricated of as slippable, low-abrasion and low-wear, flexibly resilient material as possible, POM for example.

Figure 1:
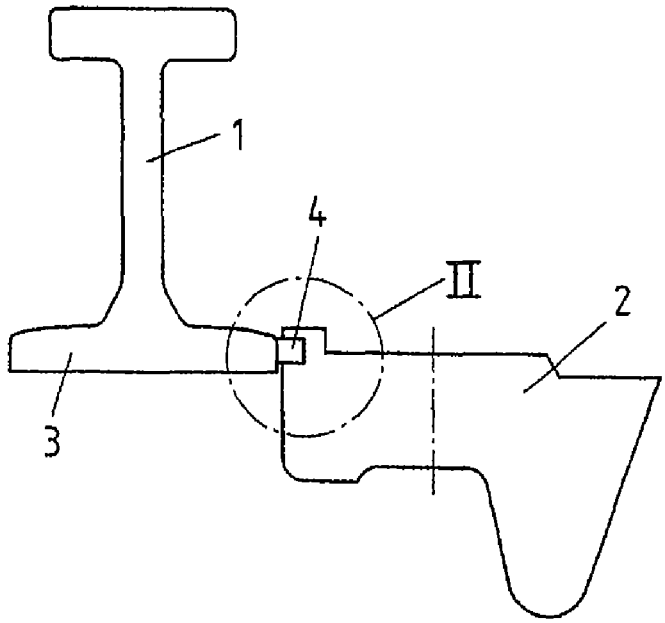
FIG. 1 shows a rail and an associated guide plate in cross section.
Figure 2:
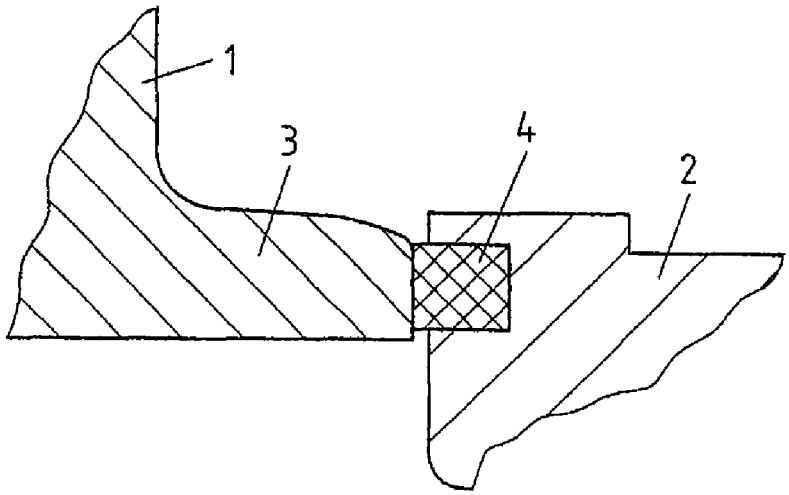
FIG. 2 shows cut-out II of FIG. 1 in enlarged view.

In the exemplary embodiment the inserts 4 are molded into the guide plate 2. Molding can take place by way of a multi-component plastic injection process. Sometimes, it is preferable if the inserts 4 protrude slightly above the contact surface of the guide plate 2, as illustrated in FIG. 2.

Figure 5:
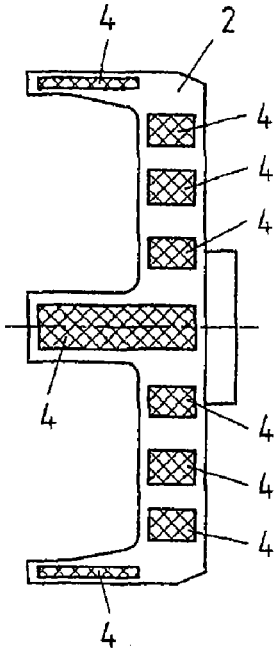
FIG. 5 shows the guide plate according to FIG. 3 seen in the view along arrow V in FIG. 3.
Figure 3:
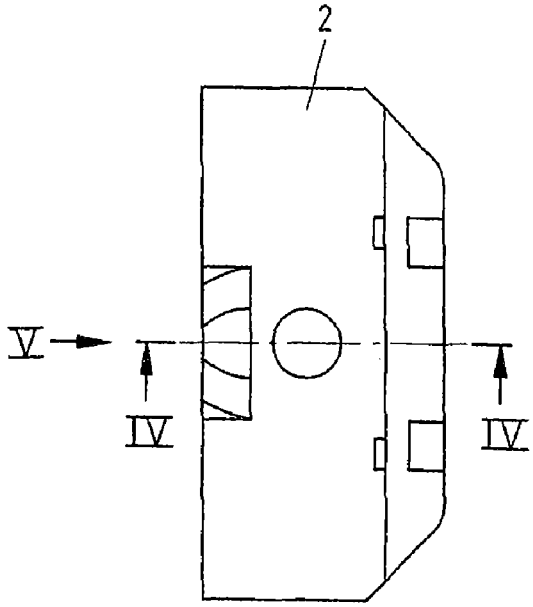
FIG. 3 shows a guide plate in plan view.

In the case of the embodiment according to FIG. 3 to FIG. 5 a spacer, which consists of a first plastic plate 5, a second plastic plate 6 and a steel plate 7 arranged in the middle of these is placed between the rail base 3 and the concrete track bed. The side edge of this steel plate 7 lies below the side edge underneath the rail base 3 likewise against the guide plate 2. A corresponding insert 4 is also provided within this area.

As a result of the corresponding arrangement of inserts made from suitable material, as this is described by the invention, the guide plate being altogether subject to less wear is achieved, if it has to absorb alternating loads, which arise whenever trains ride over the corresponding rails 1.

The invention is not restricted to the exemplary embodiments but within the limits of the disclosure is variable in many ways.

The invention claimed is:

1. A device for positional securing and guiding of rails for railway tracks for trains, wherein the rails are laid directly or indirectly by intermediate assembly of intermediate plates to fixed concrete track beds and guide plates, against which the rail base and optional intermediate plates lie laterally, are embedded on or in the concrete track beds, wherein the guide plates are fabricated of high-strength, form-stable material, and wherein the guide plate includes one or more inserts positioned lying laterally between the guide plate and the rail base to resiliently absorb a load of a rail to reduce wear on a corresponding guide plate during use, the one or more inserts being fabricated of slippable, low-abrasion or friction-resistant, low-wear or wear-resistant and flexibly resilient material.

2. Device according to claim 1, wherein the one or more inserts are fabricated of polyoxymethylene.

3. Device according to claim 1, wherein the one or more inserts are molded into the guide plate.

4. Device according to claim 1, wherein the one or more inserts are formed integrally with the guide plate by way of multi-component injection molding.

5. Device according to claim 1, wherein the one or more inserts protrude slightly above a contact surface of the guide plate.

6. Device according to claim 1, wherein a spacer made from a first plastic plate, a second plastic plate and a steel plate arranged in the middle of these is provided between rail base and concrete track bed, wherein an area of an edge at least of the steel plate lies against the one or more inserts of the guide plate.

7. Device according to claim 1, wherein the guide plates are fabricated of high-strength, form-stable material comprising a reinforced plastic.

8. Device according to claim 7, wherein the reinforced plastic comprises fiber reinforced polyamide.

* * * * *